US006032736A

United States Patent [19]

Williams

[11] Patent Number: 6,032,736

[45] Date of Patent: Mar. 7, 2000

[54] MULTI-GAGE BLOWOUT PREVENTER TEST TOOL AND METHOD

[76] Inventor: J. Terrell Williams, P.O. Box 1973, Lake Charles, La. 70602

[21] Appl. No.: 09/072,923

[22] Filed: May 5, 1998

Related U.S. Application Data

[60] Provisional application No. 60/045,776, May 5, 1997.

[51] Int. Cl.[7] ..... E21B 47/00

[52] U.S. Cl. ..... 166/250.08; 166/336; 166/337; 73/49.1; 73/40.5 R

[58] Field of Search ..... 166/336, 337, 166/250.08, 113; 73/49.1, 40.5 R, 49.8, 49.5, 46, 152.01

[56] References Cited

U.S. PATENT DOCUMENTS

| | | | |
|---|---|---|---|
| 4,347,733 | 9/1982 | Crain | 73/40.5 R |
| 4,554,976 | 11/1985 | Hynes et al. | 166/341 |
| 4,881,598 | 11/1989 | Stockinger et al. | 166/250.08 |

*Primary Examiner*—David Bagnell
*Assistant Examiner*—Chi H. Kang
*Attorney, Agent, or Firm*—Kenneth A. Roddy

[57] ABSTRACT

A multi-gage blowout preventer test tool for testing different size ram and annular BOP's in one trip has an outer test tube assembly and an inner tube assembly connected in telescoping relation. The exterior of the outer tube has a plurality of pipe gage diameters corresponding to different drill pipe sizes. A top sub at the top end of the outer tube assembly connects to the drill string and contains an upper seal assembly and stinger. The bottom end of the inner tube assembly is secured to a bottom sub and the bottom end of the outer tube assembly is releasably connected to the bottom sub in the collapsed position. The bottom sub is connected to a test plug and tail pipe assembly and the tool is lowered through the riser pipe and BOP stack to set the test plug in the wellhead. A wireline retrievable dart is sealingly engaged in the upper seal assembly and drilling fluid flow bypasses the upper seal assembly through fluid passageways between the inner and outer tube assemblies and is vented through relief ports at the lower end of the tool. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters.

10 Claims, 8 Drawing Sheets

MULTI-GAGE BLOWOUT PREVENTER TEST TOOL AND METHOD

This application claims benefit of Provisional Appl. Ser. No. 60/045,776 filed May 5, 1997.

BACKGROUND OF THE INVENTION

1. Field of the Invention

This invention relates generally to high-pressure blowout preventer testing in subsea environments, and more particularly to a telescoping multi-gage blowout preventer test tool and method for testing different size ram and annular BOP's, or choke and kill lines in one trip.

2. Brief Description of the Prior Art

Blowout preventer or BOP stacks are connected to oil and gas wellheads on the sea floor for controlling the wellhead during drilling rig operations. The blowout preventer stack will usually include several blowout preventers of various types which are capable of closing in the wellhead in the event of excessive pressures downhole. For example, a typical blowout preventer stack may include several ram-type blowout preventers (blind-ram and/or variable ram), and one or more annular blowout preventers connected above the ram-type blowout preventers. A riser pipe connected to the uppermost blowout preventer extends to the drilling rig at the surface.

Typically subsea wellheads use a tapered drill string system wherein a larger diameter drill string is used for drilling an initial portion of the well, and successively smaller diameter drill strings for drilling the lower portions of the well. Thus, the blowout preventer system must be capable, for example, of sealing off the annular space surrounding 5½" and/or 5" O.D. pipe and also 3½" O.D. drill pipe.

Testing of the blowout preventer stack is typically accomplished by connecting a test plug to a length of drill pipe of the diameter to be tested, running it into the wellhead such that the test plug seals in the wellhead, and then testing the blowout preventer system for that particular size of drill pipe. The first drill string and test plug is retrieved from the wellhead, and the process is repeated for each size of drill pipe used in the system.

This repetitive tripping or running and retrieving the test drill string to test against each of the different size drill pipes requires excessive time, labor, and expense, particularly in subsea wellheads which may be several thousand feet below the drilling platform.

There are several patents which disclose various blowout preventer testing apparatus and methods.

Crain, U.S. Pat. No. 4,347,733 discloses a blowout preventer test system utilizing a pipe nipple threaded at both ends and having a central bore through which fluid is conveyed. A reduced orifice at the central portion of the bore constricts fluid flow through the bore. The nipple has instrumentation taps through its side wall for attaching a differential pressure recording device.

Hynes et al, U.S. Pat. No. 4,554,976 discloses a blowout preventer test tool having an upper body and lower sealing body releasably connected by left-hand threads, and a check valve landed in the bore of the tool to prevent downward flow of fluid but allow upward flow and the attached drill pipe for detecting leaks of the sealing tool during pressure testing. During testing of a shear ram blowout preventer, the upper body is disconnected from the lower body by turning the drill pipe to the right. Raising the drill pipe then causes the upper body to shift a set of right-hand threads into position and move the upper body and drill pipe above the shear ram BOP allowing it to be closed for pressure testing.

Stockinger et al, U.S. Pat. No. 4,881,598 discloses a blowout preventer testing apparatus designed to close a smaller drill string pipe and a larger drill string pipe. The apparatus includes a first elongated cylindrical testing mandrel having an O.D. of the smaller drill pipe telescopingly received inside of a second elongated cylindrical testing mandrel having an O.D. of the larger drill pipe. The mandrels are releasably locked together in an extended position for testing against the first mandrel, and released to a collapsed position for testing against the second mandrel without tripping the apparatus out of the wellhead.

The present invention is distinguished over the prior art in general, and these patents in particular by a multi-gage blowout preventer test tool for testing different size ram and annular BOP's in one trip. The present tool has an outer test tube assembly and an inner tube assembly connected in telescoping relation. The exterior of the outer test tube assembly has a plurality of pipe gage diameters corresponding to different drill pipe sizes. A top sub at the top end of the outer tube assembly connects to the drill string and contains an upper seal assembly and stinger. The bottom end of the inner tube assembly is secured to a bottom sub and the bottom end of the outer tube assembly is releasably connected to the bottom sub in the collapsed position. The bottom sub is connected to a test plug and tail pipe assembly and the tool is lowered through the riser pipe and BOP stack to set the test plug in the wellhead. A wireline retrievable dart is sealingly engaged in the upper seal assembly and drilling fluid flow bypasses the upper seal assembly through fluid passageways between the inner and outer tube assemblies and is vented through relief ports at the lower end of the tool. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters.

SUMMARY OF THE INVENTION

It is therefore an object of the present invention to provide a multi-gage blowout preventer test tool and method for testing different size rams, variable bore rams, annular BOP's, or choke and kill lines and valves in one trip.

It is another object of this invention to provide a multi-gage blowout preventer test tool having an exterior with different longitudinally spaced pipe gage diameters for testing different size rams, variable bore rams, annular BOP's, or choke and kill lines and valves in one trip.

Another object of this invention is to provide a multi-gage blowout preventer test tool and method for testing different size rams, variable bore rams, annular BOP'S, or choke and kill lines and valves which allows fluid communication between the wellbore and riser to be maintained at all times while testing.

Another object of this invention is to provide a longitudinally telescoping multi-gage blowout preventer test tool having different longitudinally spaced pipe gage diameters which can be accurately positioned for testing different selected size rams, variable bore rams, annular BOP's, or choke and kill lines and valves.

A further object of this invention is to provide a multi-gage blowout preventer test tool utilizing a wireline retrievable dart sealing member which allows full fluid flow while tripping or for safety.

A still further object of this invention is to provide a multi-gage blowout preventer test tool which is simple in construction and rugged and reliable in operation.

Other objects of the invention will become apparent from time to time throughout the specification and claims as hereinafter related.

The above noted objects and other objects of the invention are accomplished by the present multi-gage blowout preventer test tool for testing different size ram and annular BOP's in one trip. The tool has an outer test tube assembly and an inner tube assembly connected in telescoping relation. The exterior of the outer test tube assembly has a plurality of pipe gage diameters corresponding to different drill pipe sizes. A top sub at the top end of the outer tube assembly connects to the drill string and contains an upper seal assembly and stinger. The bottom end of the inner tube assembly is secured to a bottom sub and the bottom end of the outer tube assembly is releasably connected to the bottom sub in the collapsed position. The bottom sub is connected to a test plug and tail pipe assembly and the tool is lowered through the riser pipe and BOP stack to set the test plug in the wellhead. A wireline retrievable dart is sealingly engaged in the upper seal assembly and drilling fluid flow bypasses the upper seal assembly through fluid passageways between the inner and outer tube assemblies and is vented through relief ports at the lower end of the tool. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters.

DESCRIPTION OF THE PREFERRED EMBODIMENT

Figure 1:
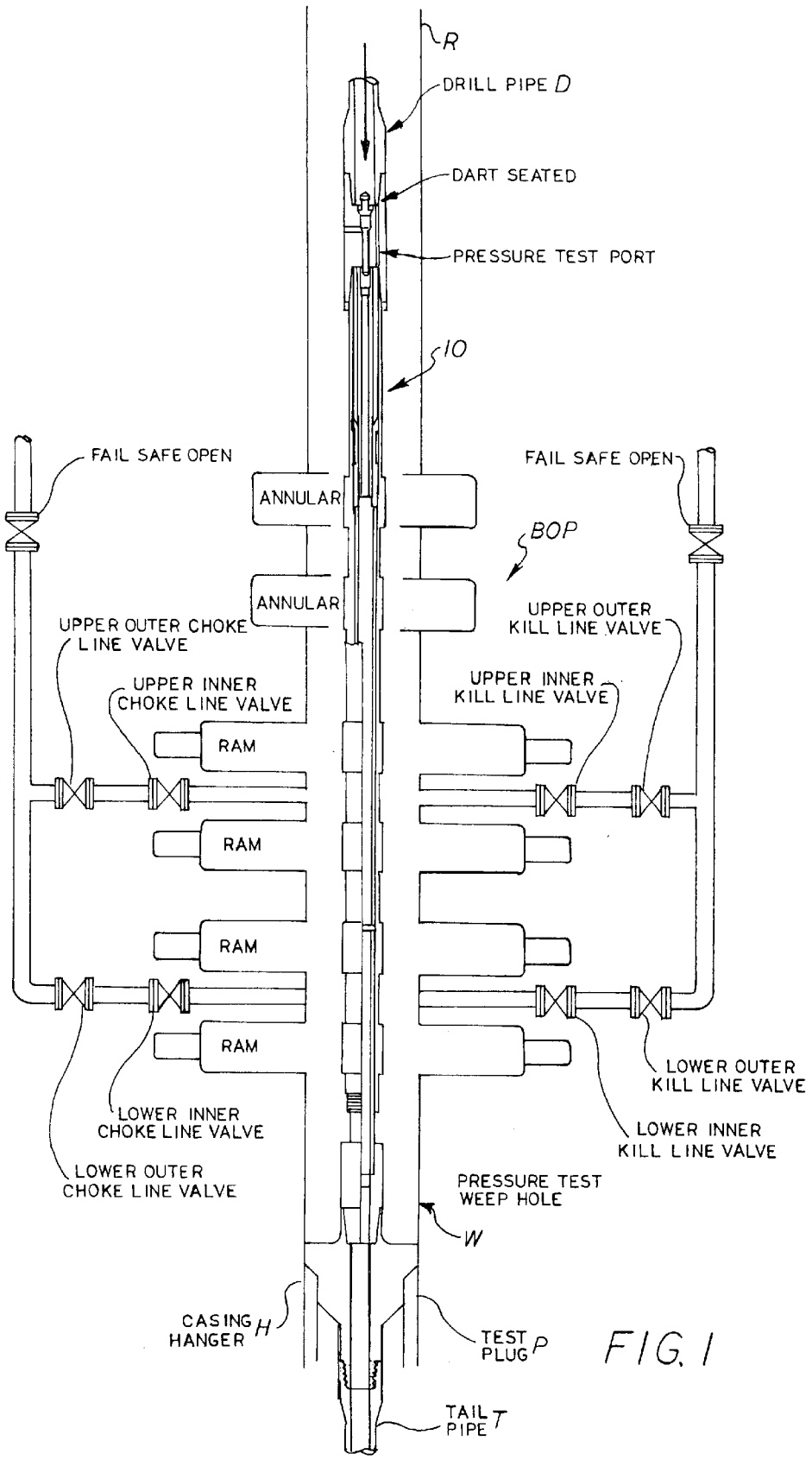
FIG. 1 is a schematic elevation view in partial cross section showing a multi-gage blowout preventer test tool in accordance with a preferred embodiment of the invention attached to a drill string inside a conventional subsea BOP stack.

Referring to the drawings by numerals of reference, there is shown schematically in FIG. 1, a typical conventional blowout preventer stack (BOP) connected to a subsea wellhead W on the sea floor. In the illustrated example, the blowout preventer stack includes several ram-type blowout preventers (blind-ram and/or variable ram), and a pair of annular blowout preventers connected above the ram-type blowout preventers. A riser pipe R connected to the uppermost blowout preventer extends to the drilling rig at the surface (not shown). The wellhead W includes a casing hanger H, and the BOP stack includes the conventional piping with choke valves, kill valves, and fail safe valves.

A multi-gage blowout preventer test tool 10 in accordance with a preferred embodiment of the invention is shown inside the BOP stack and connected at its upper end to the lower joint of a drill pipe string D and having a conventional test plug P connected at its lower end which is seated in the casing hanger of the wellhead.

Referring additionally to FIGS. 2A, 2B, 3A, 3B, and 4, the multi-gage BOP test tool 10 is an elongate tubular member including an elongate outer test tube assembly 11 slidably received on and surrounding an elongate inner tube assembly 70 in axially telescoping relation. The outer test tube assembly 11 includes an elongate tubular upper test tube member 11U having a central bore 12 and a female threads 13 in its bottom end. An elongate tubular lower test tube member 11L having male threads 14 at its upper end is threadedly connected to the bottom end of the upper test tube member 11U. An annular seal 15 in a straight nose portion 15A above the threaded connection 13,14 seals the threaded connection. The lower test tube member 11L has a central bore 16 smaller in diameter than the central bore 12 of the upper test tube member 11U such that the top face of the lower test tube member serves as an upwardly facing annular stop shoulder 17.

Figure 2A:
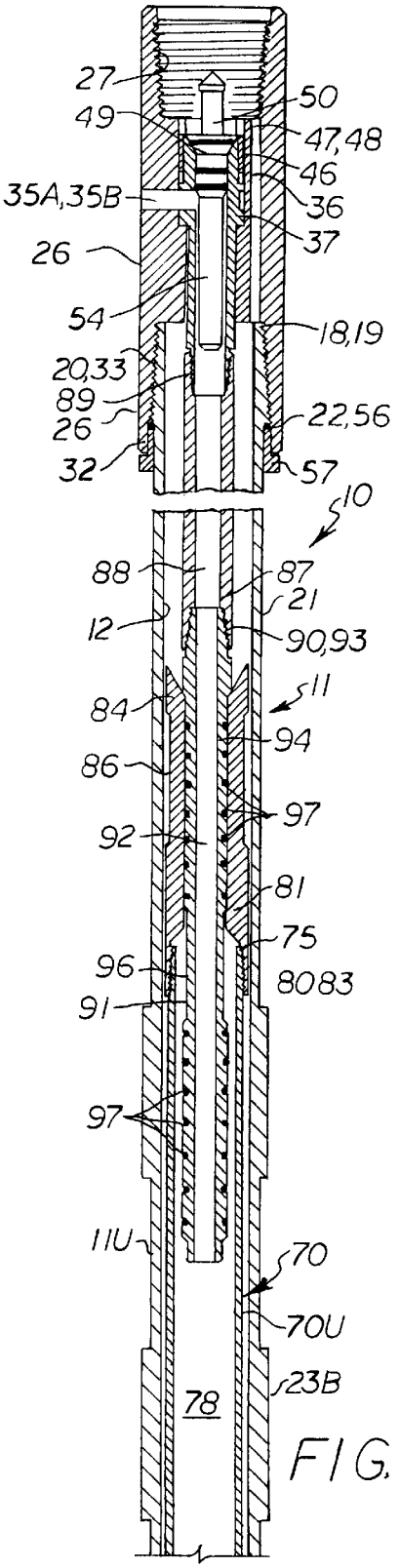
FIGS. 2A and 2B taken together is a longitudinal cross section through the multi-gage blowout preventer test tool showing it in a collapsed position.
Figure 3A:
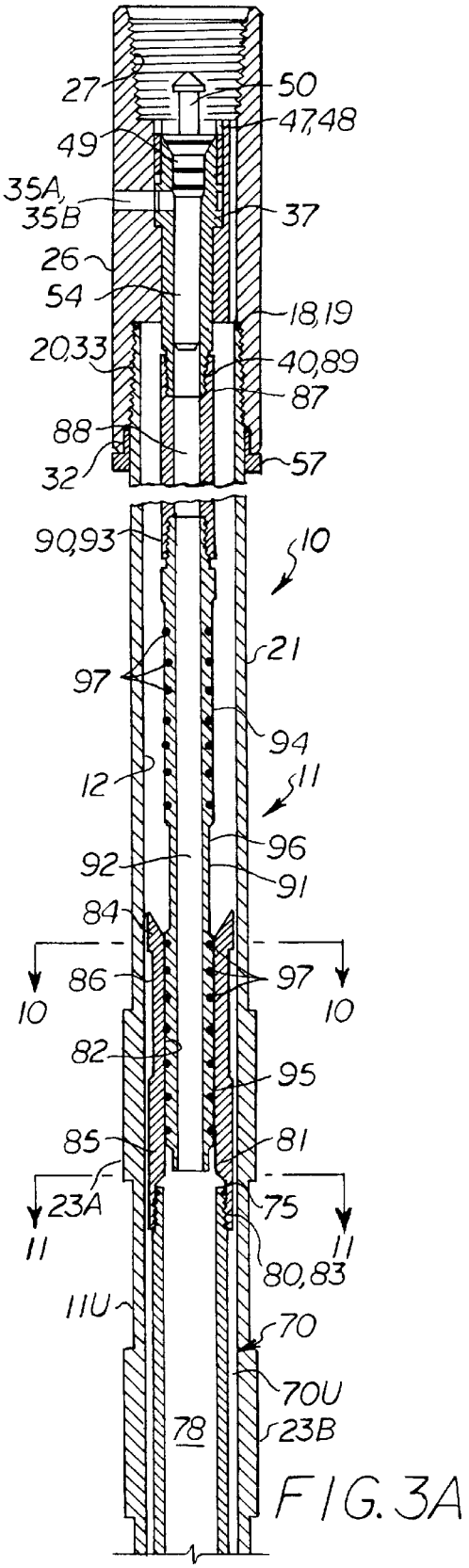
FIGS. 3A and 3B taken together is a longitudinal cross section through the multi-gage blowout preventer test tool showing it in an extended position.
Figure 5:
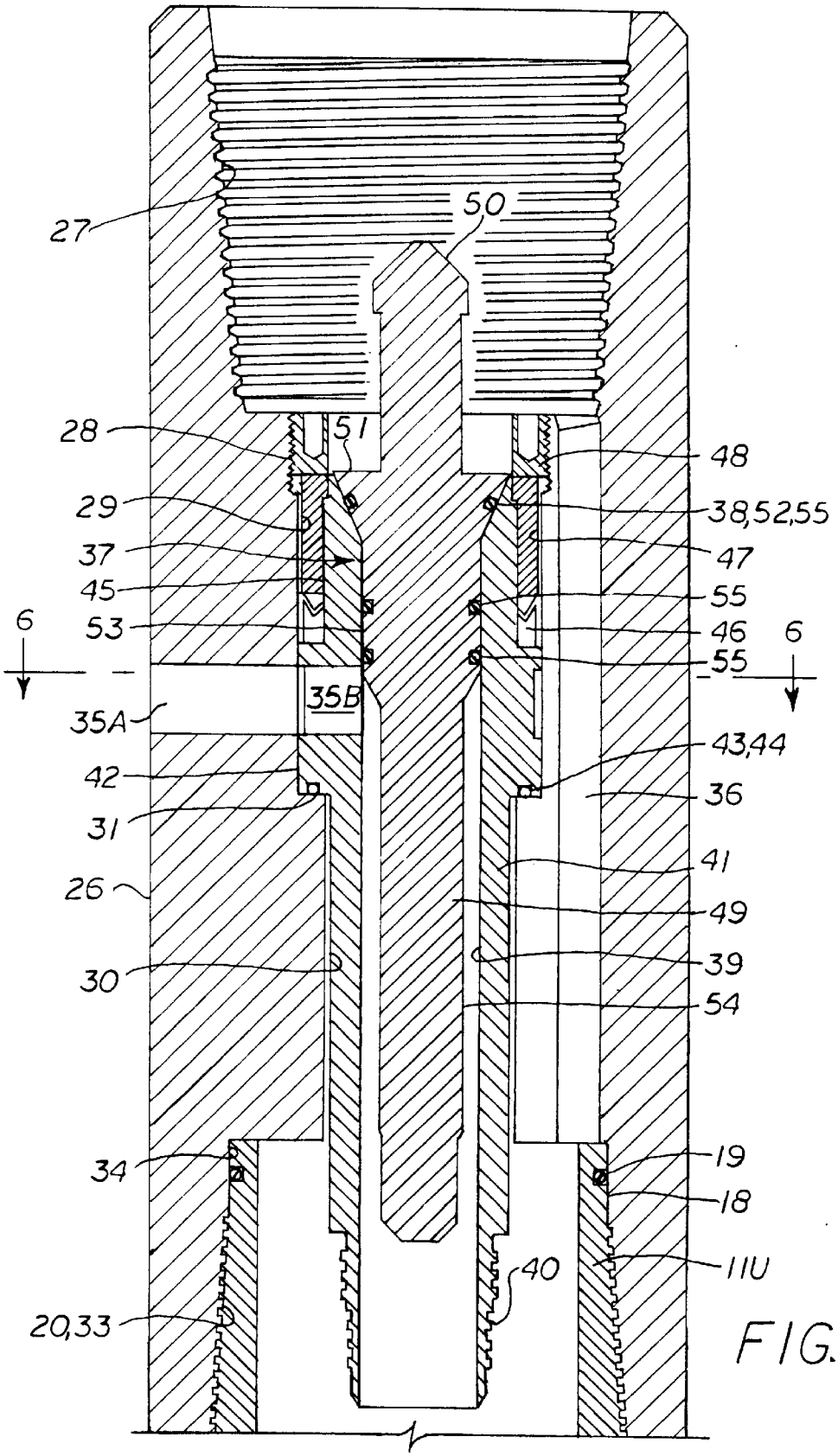
FIG. 5 is a longitudinal cross section through the top sub assembly showing the assembled components in greater detail.

As best seen in FIGS. 2A, 3A, and 5, the exterior of the upper test tube member 11U has a straight nose portion 18 at its top end with an annular seal 19, male threads 20 beneath the nose portion 18, and a first reduced diameter portion 21 below the threads 20 defining a downwardly facing annular shoulder 22 therebetween. A first 23A, second 23B, third 23C, and fourth 23D enlarged pipe gage diameter portion are longitudinally spaced a distance apart on the exterior of the upper test tube member 11U below the annular shoulder 22. A fifth enlarged pipe gage diameter portion 23E is formed on the exterior of the lower test tube member 11L a distance below the threaded connection 13,14. The pipe gage diameters 23A–23E are machined to correspond to each of the various diameters of the drill pipe used in the wellhead system.

The bottom end of the lower test tube member 11L is provided with coarse left-hand straight male threads 24. At least one port 25 extends radially outward through the side wall of the lower test tube member 11L above the threads 24 in fluid communication between the interior of the outer test tube assembly 11 and the exterior.

Referring again to FIG. 5, a top sub 26 is connected to the top end of the upper test tube member 11U. The top sub 26 is a tubular member having a first set of female tapered threads 27 at its top end which threadedly receive and engage the pin end of the drill string, a second set of female straight threads 28 of smaller diameter extending a distance downwardly from the first threads, and a first bore 29 extending downwardly from the threads 28 terminating in a smaller diameter second bore 30 defining an upwardly facing annular shoulder 31 therebetween. The bottom end of the top sub 26 is provided with a set of female straight threads 32 extending upwardly from the bottom end, and a set of female tapered threads 33 extending upwardly and terminating in a straight bore 34 larger in diameter than the bore 30.

Figure 6:
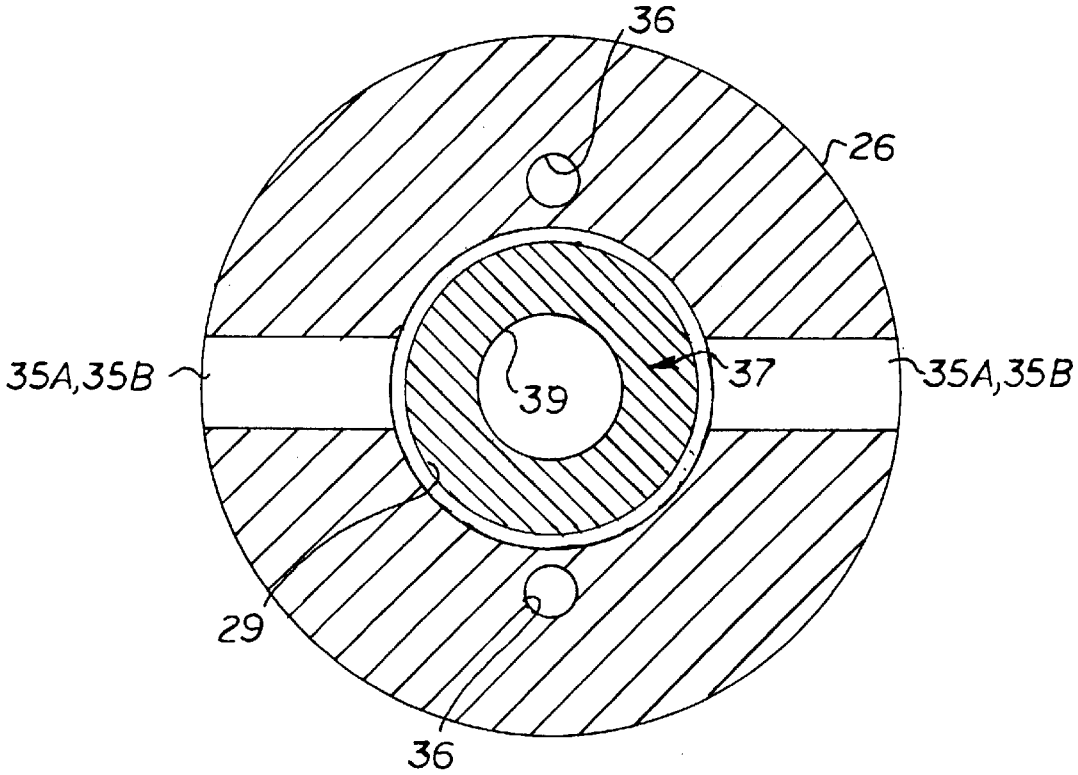
FIG. 6 is a transverse cross section through the top sub assembly taken along line 6—6 of FIG. 5, with the dart removed and showing the ports and bores in their true position.

Referring now to FIGS. 5 and 6, a pair of diametrically opposed transverse ports 35A extend radially outward through the side wall of the top sub 26 from the bore 29 to the exterior. A pair of vertical bores 36 spaced radially outward from the bore 29 and spaced 90 degrees from the transverse bores 35A extend downward through the top sub 26. It should be noted that in FIG. 5, the vertical bore 36 is shown rotated 90 degrees from its actual position depicted in FIG. 6.

A tubular upper seal assembly 37 is mounted in the top sub 26. The interior of the upper seal assembly 37 has a tapered bore 38 extending downwardly and inwardly from the top end and terminating in a central bore 39. The exterior of the upper seal assembly 37 has male threads 40 at its bottom end and a small diameter lower portion 41 extending upwardly therefrom and terminating in a larger diameter portion 42 defining a downwardly facing annular shoulder 43 therebetween. An annular seal 44 is installed in the shoulder 43. A reduced diameter portion 45 extends downwardly from the top end of the upper seal assembly 37

The upper seal assembly 37 is installed in the top sub 26 with its small diameter lower end 41 extending downwardly through the bore 30 and its shoulder 43 and seal 44 engaged on the shoulder 31. A cup-type packing set 46 is installed on the reduced diameter upper portion 45. A pair of transverse bores 35B extend through the side wall of the seal assembly 37 beneath the packing set 46 in axial alignment with the bores 35A in the top sub 26. The seal assembly 37 is retained in place, the seal 44 is compressed into sealing relation on the shoulder 43, and the packing 46 is compressed into sealing relation on the bore 29 by a retaining sleeve 47 and a retaining nut 48 threadedly engaged in the straight threads 28.

As described in detail hereinafter, a wireline retrievable dart 49 is removably received in the upper seal assembly 37. The dart 49 has a fishing neck 50 at its top end extending upwardly from a flat upward facing surface 51, a downward and inwardly tapered portion 52 below the fishing neck, and a straight intermediate portion 53 extending downward from the tapered portion terminating in a reduced diameter straight lower portion 54. The tapered portion 52 and intermediate portion 53 are provided with annular seals 55. The tapered portion 52 is received in the tapered bore 38, the intermediate portion 53 is received in the bore 39, and the reduced lower portion 54 extends downwardly through the central bore 39 defining an annulus therebetween. When subjected to downward force, the seals 55 form a fluid sealing relation with the mating surfaces.

The straight bore 34 and tapered threads 33 at the bottom end of the top sub 26 are received and threadedly engaged on the straight nose portion 18 and male threads 20 at the top end of the upper test tube member 11U. The annular seal 19 seals the threaded connection.

As shown in FIGS. 2A and 3A, a lock ring 56 is installed beneath shoulder 22 on the upper test tube member 11U and a lock nut 57 is threadedly engaged in the second set of threads 32 in the bottom end of the top sub 26 to secure and lock the threaded connection.

Referring again to FIGS. 2B and 3B, a bottom sub 58 is releasably connected to the bottom end of the lower test tube member 11L. The interior of the bottom sub 58 has a coarse left-hand straight female threaded portion 59 which extends downwardly a distance from its top end, a tapered female threaded portion 60 extending downwardly from the straight threaded portion, and a central bore 61. The exterior of the bottom sub 58 is provided with male threads 62 at its bottom end.

Figure 2B:
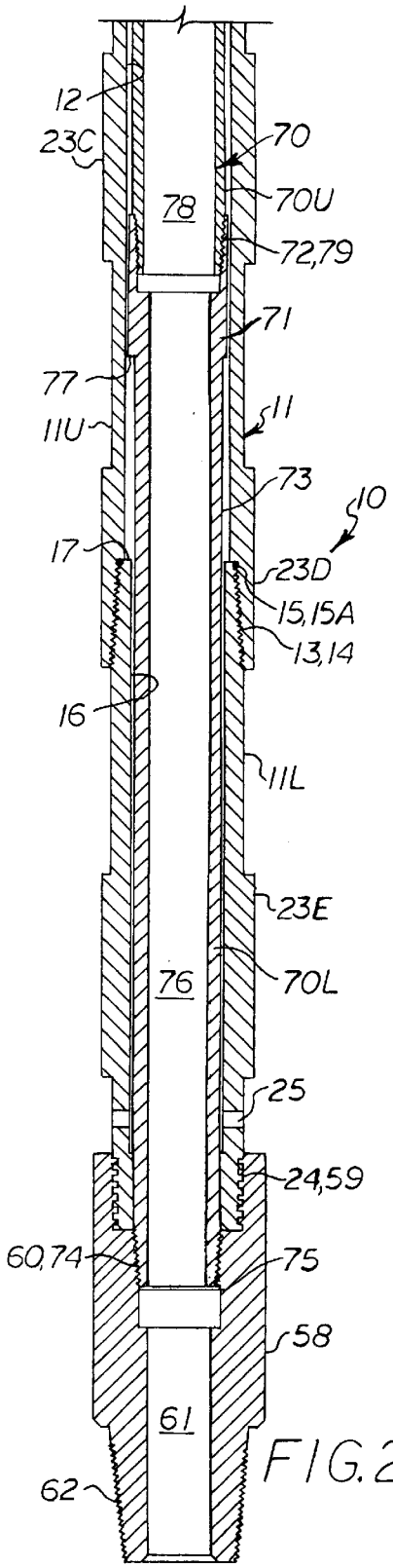
Figure 3B:
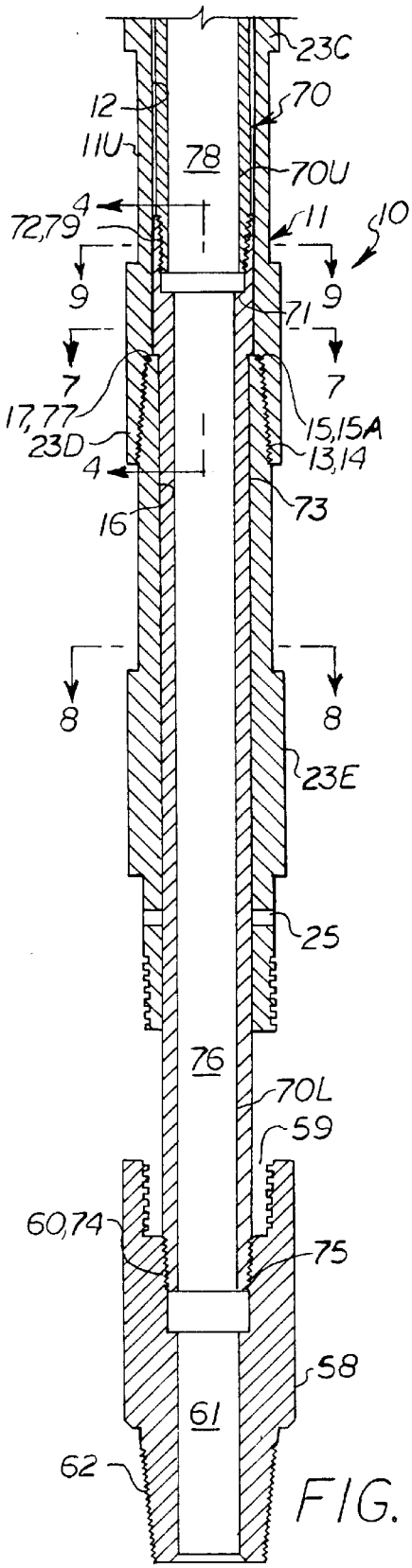

As seen in FIG. 2B, the coarse left-hand straight male threads 24 at the bottom end of the lower test tube member 11L are threadedly engaged in the coarse left-hand straight female threads 59 in the top end of the bottom sub 58. The straight left-handed threaded connection 24,59 forms a positive release rotation joint to allow the lower test tube member 11L (and outer tube assembly 11) to become disengaged or uncoupled from the bottom sub 58 (as seen in FIG. 3B) for telescoping action of the test tool 10, described hereinafter.

As seen in FIG. 1, the male threads 62 at the bottom end of the bottom sub 58 are threadedly engaged in the upper end of a conventional test plug P which is to be supported in a casing hanger H a distance below the BOP stack and a tail pipe assembly T (tubing and collars) is threadedly connected to the bottom of the test plug and extends downwardly therefrom.

Referring again to FIGS. 2A, 2B, 3A, 3B, and 5, the inner tube assembly 70 includes an elongate tubular lower tube member 70L at its lower end, an elongate upper tube member 70U connected to the upper end of the lower tube member, and an elongate tubular polished bore receptacle 81 connected to the upper end of the upper tube member 70U.

The lower tube member 70L has an enlarged diameter collar portion 71 at its top end provided with female threads 72, and a reduced diameter exterior 73 extending downwardly from the collar portion 71 with male threads 74 and an annular seal 75 at its bottom end threadedly engaged in the female threads 60 of the bottom sub 58. A central bore 76 extends through the lower tube member 70L. The lower tube member 70L extends upwardly from the bottom sub 58 inside the outer upper and lower test tube members 11U and 11L (outer test tube assembly 11). The enlarged collar portion 71 and reduced diameter 73 define a downward facing stop shoulder 77.

The upper tube member 70U has a central bore 78 and male threads 79 at its bottom end threadedly engaged in the threads 72 of the collar portion 71 of the lower tube member 70L and extends upwardly therefrom. The upper end of the upper tube member 70U is provided with male threads 80.

The elongate tubular polished bore receptacle 81 has a central polished bore 82 and female threads 83 at its bottom end threadedly engaged on the male threads at the upper end of the upper tube member 70U. The exterior of the polished bore receptacle 81 has an enlarged diameter upper portion 84 and lower portion 85 with a reduced diameter portion 86 therebetween.

Figure 4:
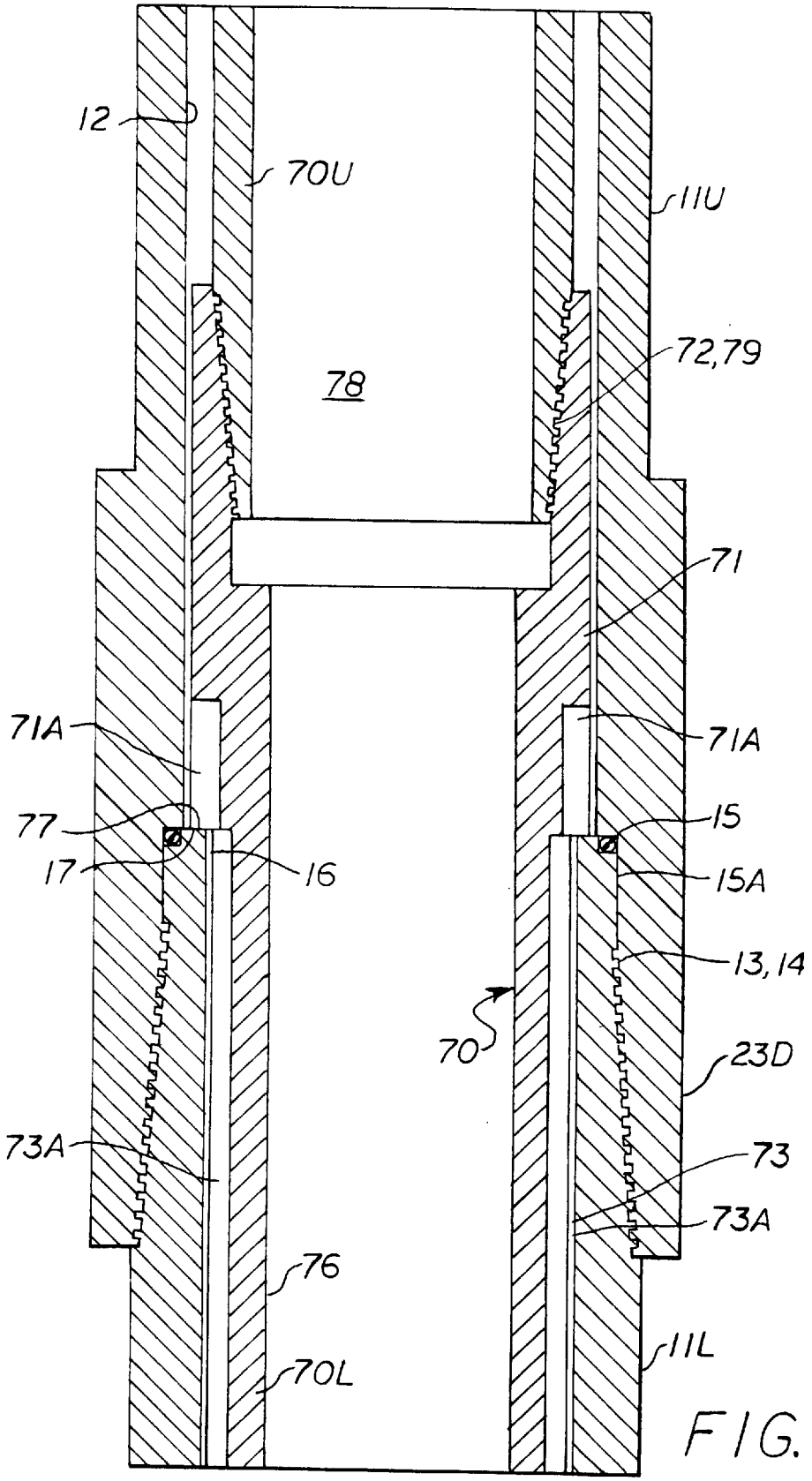
FIG. 4 is a longitudinal cross section through the multi-gage blowout preventer test tool taken along line 4—4 of FIG. 3B.
Figure 7:
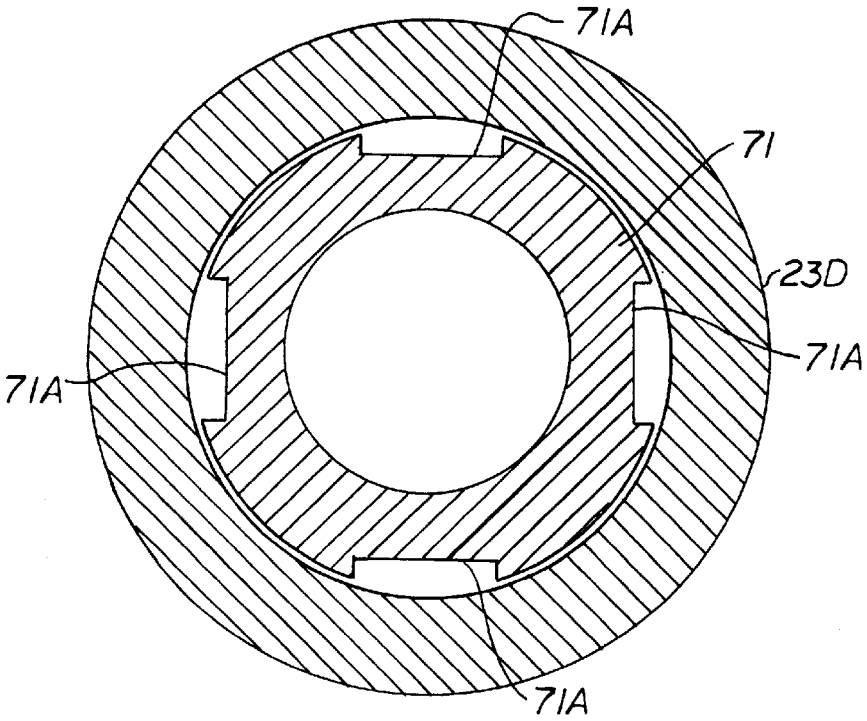
FIG. 7 is a transverse cross section through the multi-gage blowout preventer test tool taken along line 7—7 of FIG. 3B.
Figure 8:
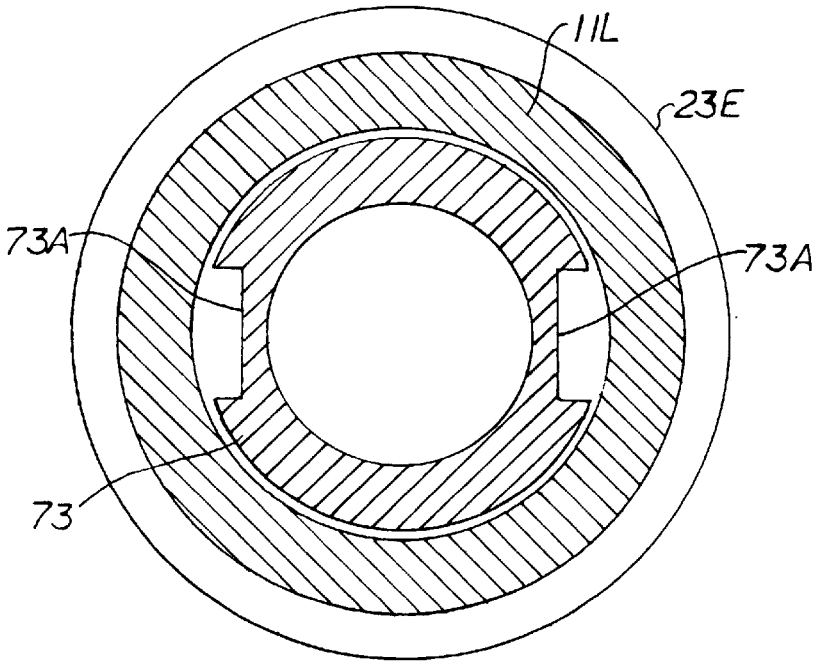
FIG. 8 is a transverse cross section through the multi-gage blowout preventer test tool taken along line 8—8 of FIG. 3B.

As seen in FIGS. 4, 7, and 8, the exterior lower portion of the collar portion 71 of the lower tube member 70L is provided with circumferentially spaced slots or flutes 71A and the reduced diameter exterior 73 of the lower tube member 70L is provided with longitudinal slots or flutes 73A in fluid communication with the upper flutes 71A.

Figure 9:
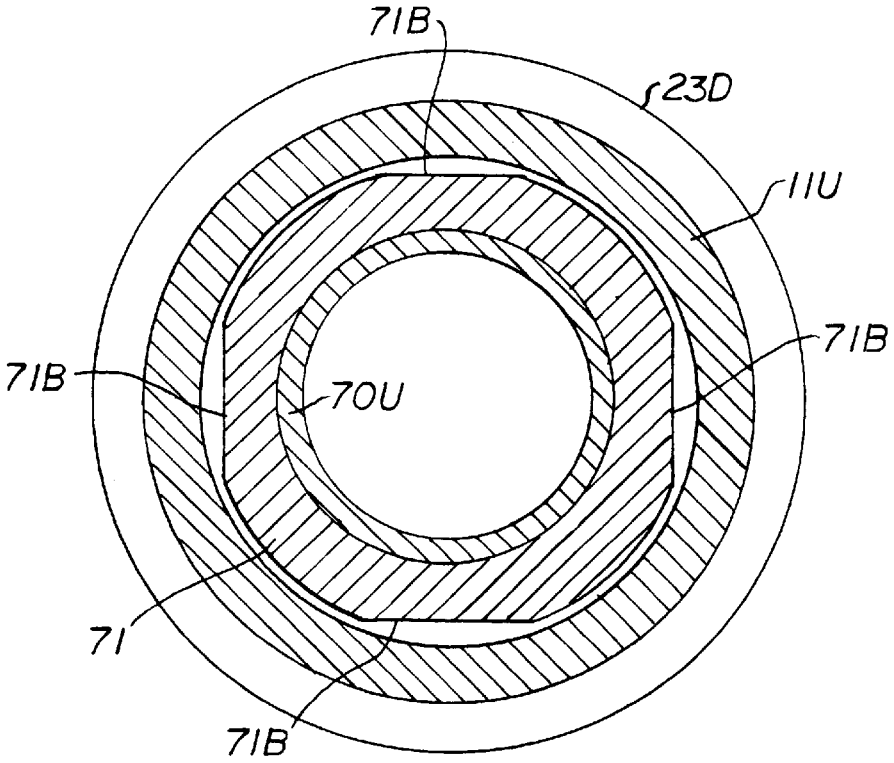
FIG. 9 is a transverse cross section through the multi-gage blowout preventer test tool taken along line 9—9 of FIG. 3B.
Figure 10:
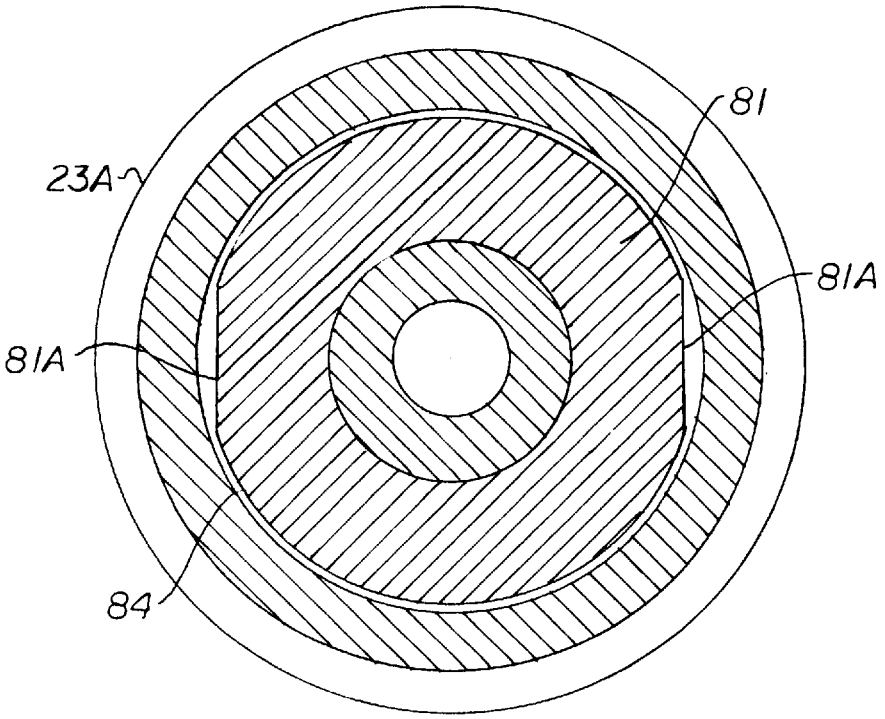
FIG. 10 is a transverse cross section through the multi-gage blowout preventer test tool taken along line 10—10 of FIG. 3B.
Figure 11:
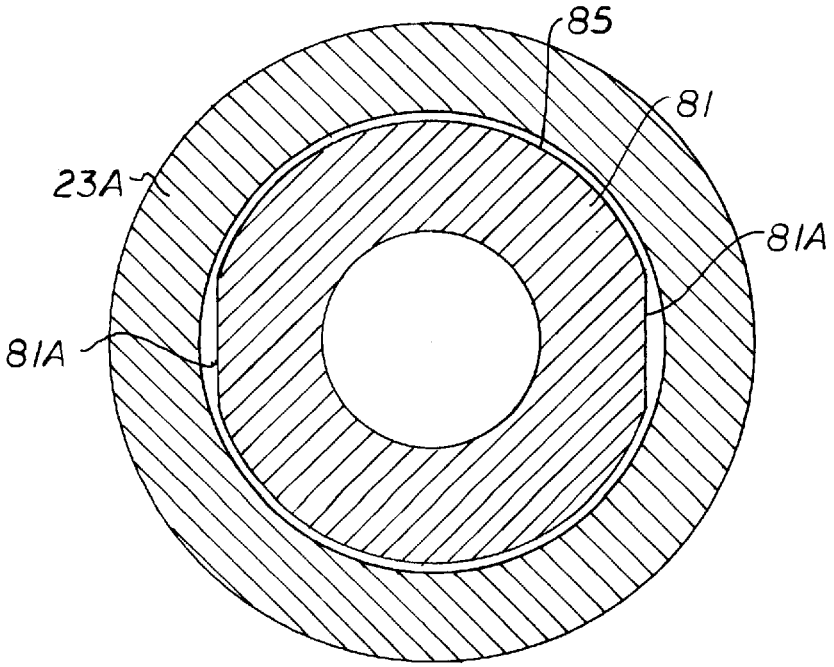
FIG. 11 is a transverse cross section through the multi-gage blowout preventer test tool taken along line 11—11 of FIG. 3B.

As seen in transverse cross section in FIG. 9, the upper portion of the exterior of the collar portion 71 of the lower tube member 70L is provided with longitudinal flats 71B. As seen in FIGS. 10 and 11, the exterior of the enlarged diameters 84 and 85 of the polished bore receptacle 81 are provided with flats 81A.

Referring again to FIGS. 2A and 3A, a tubular double box sub 87 having a central bore 88 and female threads 89 at its top end is threadedly engaged on the threads 40 at the bottom end of the upper seal assembly 37, and is provided with female threads 90 at its bottom end. An elongate tubular stinger 91 having a central bore 92 and male threads 93 at its top end is threadedly engaged in the bottom end of the double box sub 87. The exterior of the stinger 91 has an upper enlarged diameter 94 and a lower enlarged diameter 95 with a reduced diameter portion 96 therebetween. A plurality of annular seals 97 are installed on the enlarged diameter portions 94 and 96 in longitudinally spaced relation.

The length of the-double box sub 87 may be re-machined to adjust for variations in the length of the inner tube to avoid having to re-machine the more complex components of the tool.

In operation the BOP test tool 10 is assembled and the top sub 26 of the BOP test tool with the upper seal assembly 37 and stinger 91 installed is connected to the lower joint of the drill pipe string and the bottom ends of the inner tube and outer test tube assemblies 70 and 11 are connected to the bottom sub 58 as shown in FIGS. 1, 2A and 2B and described above. The upper tube member 11L of the outer test tube assembly 11 is secured to the top sub 58 by the lock ring 56 and lock nut 57, the left-hand threads 24 of the lower outer tubular member 11L are releasably engaged in the left-hand threads 59 at the top end of the bottom sub 58, and the tool is in the collapsed telescoped position.

The bottom sub 58 is connected to a conventional test plug P and tail pipe assembly T (pipe and collars), and the whole assembly is lowered down through the riser pipe R and BOP stack to set the test plug down in the wellheadhead casing hanger H. The wireline retrievable dart 49 may be run in place, dropped from the surface, or pumped down after the test plug P has been seated in the casing hanger H. The dart 49 is held firmly in position in the upper seal assembly 37 by drilling fluid flow and pressure acting in its flat surface 51, indicated by the arrow in FIG. 5 and the dart seals 55 form a sealing relation with the bores 38,39. The seals 97 on the upper enlarged diameter 94 of the stinger 91 are in sealing relation on the polished bore 81 of the polished bore receptacle 81, and the lower enlarged diameter 95 of the stinger is disposed beneath the polished bore.

A differential hydraulic pressure of the drilling fluid arises due the restriction formed at the upper seal assembly by the dart 49 and holds dart in position during the testing operation. The fluid bypasses the upper seal assembly 37 through the vertical bores 36, through the flats 81A on the exterior of the polished bore receptacle 81, through the annulus between the upper inner tube member and outer upper test tube members 70U and 11U, through the flutes 71A and flats 71B on the lower tube member collar 71, and into the annulus (flutes 73A) between the lower tube member 70L, the lower outer test tube member 11L, and is vented through the relief ports 25 at the lower end of the lower test tube member 11L.

Fluid and pressure from the wellhead bore can flow upwardly through the bore 61 of the bottom sub 58, the bore 76 of the inner lower tube member 70L, the bore 78 of the inner upper tube member 70U, the bore 92 of the stinger 91, the bore 88 of the double box sub 87, through the annulus around the lower portion 54 of the dart 49 and through the ports 35A,35B of the seal assembly 37 and top sub 26, and into the riser pipe.

As explained hereinafter, the rams and annular BOPs are tested against a set of corresponding pipe gage diameters on the outer test tube assembly 11 in its collapsed condition, and then the left-hand threads 24 are uncoupled from the bottom sub 58 and the outer test tube assembly 11 is lifted to telescope upwardly until the stop shoulder 17 on the top end of the lower test tube member contacts the stop shoulder 77 on the bottom of the collar 71 of the inner lower tube member 70L, and the tool assumes the extended position as shown in FIGS. 3A and 3B. The extended position is indicated at the surface by an increase in string weight.

In the extended position, the lower enlarged diameter 95 of the stinger 91 is received in the polished bore 82 of the polished bore receptacle 81 and its seals 97 are engaged in sealing relation therewith.

When the tool is in the extended position, another set of the pipe gage diameters on the outer test tube assembly 11 are axially positioned within the BOP stack and the rams and annular BOPs are then tested against the second axially positioned set of corresponding pipe gage diameters.

To insure accuracy in alignment of the pipe gage diameters, a spacer sub (not shown) may be installed between the test plug and the multi-gage blowout preventer test tool to compensate for the variation in the top of the wellheadhead relative to the ram centerline.

Operation

The following is a description of a typical testing operation utilizing the shearable multi-gage blowout preventer test tool.

The test tool is placed in the V-door of the rig and the rig elevators are latched around the tool and the tool is picked up in the derrick. The BOP test tool is connected to the test plug with the tail pipe assembly (25,000 lb. minimum weight recommended) attached.

The left-hand threaded connection between the bottom sub and lower test tube member is checked for complete make up with chain tongs. Seven revolutions are required for make up. Care should be taken to avoid over torquing.

The BOP test tool, test plug, and tail pipe assembly is lowered into the well by the drill pipe. After the test plug is lowered into the BOP stack, the top test sub is made up between the drill pipe and the top drive.

Drilling fluid or mud is circulated down the drill pipe, the BOP test tool, the test plug, and tail pipe to insure that the test assembly and BOP stack is filled with drilling fluid.

After this circulation is completed, the dart is dropped down the drill pipe. Drilling fluid or mud is then pumped down the drill pipe string to insure that the capacity of the BOP test tool has been circulated and the dart is seated.

The string weight is recorded, and the tool is lowered to seat the test plug in the wellhead.

The ram or annular BOPs are closed and are tested in accordance with the manufacturer's test procedure by testing down the drill pipe.

The ram BOPs (including Variable Bore Ram) are tested against the corresponding-pipe gage diameters of the outer test tube assembly of the BOP test tool. The annular BOPs are tested against the corresponding pipe gage diameters of the outer test tube assembly of the BOP test tool.

After all the appropriate ram and annular BOPs and valve tests have been performed against the corresponding pipe gage diameters, the drill pipe is pick up to obtain neutral weight at the wellhead. The drill pipe is rotated slowly to the right to release the outer test tube assembly from the bottom sub. Seven right-hand turns at the wellhead is required to release the lower outer test tube and allow telescoping motion. The test tool can them be telescoped out (extended).

The motion compensator is engaged and the drill pipe and outer test tube assembly is lifted (telescoped upward) until the stop shoulder of the lower test tube member contacts the stop shoulder on the collar portion of the inner lower tube member. The inner tube assembly, test plug, and tail pipe assembly, will remain stationary. The pick up weight will be less this weight (the weight of the tail pipe, test plug and inner tube, i.e., +/−25,000 lbs.). The pick up weight will increase (indicated by the weight indicator) when the outer test tube assembly is extended and contact with the stop shoulder is made. Care should be taken not to pick up more than 5,000 lbs. above the weight of the drill string less the weight of the inner tube, test plug, and tail pipe, so that the test plug will not be unseated. The weight indicated by the weight indicator is recorded.

The motion compensator will maintain the BOP test tool in the extended position while the second set of tests are performed.

The ram and annular BOPs are closed and tested in accordance with the manufacturer's recommended test procedure. The ram BOPs (including Variable Bore Ram) are tested against the corresponding pipe gage diameters of the outer test tube assembly, and the annular BOPs are tested against the corresponding pipe gage diameters of the outer test tube assembly.

All tests are performed down the drill pipe. If elected to do so, tests can be performed down the choke or kill lines and pressure will also be on the drill pipe.

After all tests are complete the ram and annular BOPs are opened, and the drill pipe, BOP test tool, test plug, and tail pipe assembly is pulled out of the wellbore. If desired, the dart can be retreived prior to pulling the drill string.

After the drill pipe is retreived from the wellbore, the test plug is set in the rotary and, if not previously removed, the dart is removed from the test tool with the retreiving tool or wireline overshot.

The BOP test tool is then cleaned, the left-hand threads at the bottom of the of the outer lower test tube member are made up in the top of the bottom sub with chain tongs. The seal assembly can be removed from the test tool for inspection, and to replace the seals if necessary or desired. After replacing the seals and inspecting the seal assembly, the seal assembly is relaced in the test tool and the BOP test tool is now ready for use again when needed.

While this invention has been described fully and completely with special emphasis upon a preferred embodiment, it should be understood that within the scope of the appended claims the invention may be practiced otherwise than as specifically described herein.

I claim:

1. A multi-gage blowout preventer test tool for testing different size ram and annular subsea blowout preventers in one trip, comprising:

an inner tube assembly;

a lower connecting member at a lower end of said inner tube assembly for connecting said inner tube assembly to a wellheadhead sealing tool;

an outer test tube assembly surrounding said inner tube assembly and having a plurality of longitudinally spaced pipe gage diameters formed on an exterior surface thereof corresponding in size to outside diameters of different drill pipe diameters;

releasable and connectable coupling means at a lower end of said outer test tube assembly for selective connection to said lower connecting member to allow axial telescoping movement of said outer test tube assembly relative thereto and to said inner tube assembly in a released condition, and to prevent relative movement relative thereto in a connected condition;

an upper connecting member at an upper end of said outer test tube assembly for connecting said test tube assembly to a drill pipe string and moving said outer test tube axially;

in said connected condition, a first set of said longitudinally spaced pipe gage diameters of said outer test tube assembly being positioned within said blowout preventers for testing said blowout preventers against said first set of pipe gage diameters; and in said released condition, a second set of said longitudinally spaced pipe gage diameters of said outer test tube assembly being positioned within said blowout preventers for testing said blowout preventers against said second set of pipe gage diameters.

2. The multi-gage blowout preventer test tool according to claim 1, wherein said upper connecting member has an upper central bore in communication with the interior of said drill pipe string and an elongate tubular sealing assembly below said upper central bore with a depending lower portion slidably and sealingly received in an upper portion of said inner tube assembly, said sealing assembly having a central bore in communication with said upper central bore and a shut-off receiving and seating surface at an upper end thereof for receiving a shut-off member, and fluid flow bypass passageways isolated from said shut-off receiving and sealing surfaces and said depending lower portion;

said inner tube assembly has a central bore in communication with said sealing assembly central bore;

said lower connecting member has a central bore in communication with said inner tube assembly central bore and with a central bore of said wellheadhead sealing tool;

said outer test tube assembly and said inner tube assembly has fluid flow passageways therebetween isolated from said inner tube assembly central bore, and said outer test tube assembly has a port at a lower end above said coupling means extending radially between its interior and exterior;

said coupling means at a lower end of said outer test tube assembly has a central bore; and upon a shut-off member being received and seated in said shut-off receiving and seating surface at said upper end of sealing assembly, drilling fluids conducted from said drill pipe string pass through said upper central bore, through said sealing assembly bypass passageways, through said fluid flow passageways between said inner tube assembly and said outer test tube assembly, and through said port at the lower end of said outer test tube assembly; whereby fluids may be circulated through said tool during testing operations.

3. The multi-gage blowout preventer test tool according to claim 2, wherein said upper connecting member and sealing assembly have axially aligned ports extending radially from said sealing member central bore to the exterior of said upper connecting member; whereby fluid and pressure is conducted through said wellheadhead sealing tool central bore, said lower connecting member central bore, said inner tube assembly central bore, said sealing assembly central bore, and through said axially aligned ports extending radially from said sealing member central bore to the exterior of said upper connecting member.

4. The multi-gage blowout preventer test tool according to claim 2, wherein said elongate tubular sealing assembly depending lower portion has a plurality of circumferential longitudinally spaced seal elements; and said inner tube assembly has a receptacle at an upper end with a central polished bore for receiving said seal elements; whereby said depending lower portion is maintained in sealing relation with said inner tube assembly when said outer test tube assembly is in said connected condition and in said released condition.

5. The multi-gage blowout preventer test tool according to claim 2, further comprising a shut-off member removably received in said shut-off receiving and seating surface at said upper end of said sealing assembly.

6. The multi-gage blowout preventer test tool according to claim 5, wherein said shut-off member is a wireline retrievable dart having sealing surfaces at an upper end engageable in sealing relation on said shut-off receiving and seating surface at said upper end of said sealing assembly.

7. The multi-gage blowout preventer test tool according to claim 6, wherein said dart has an enlarged surface area at an upper end beneath said upper connecting member upper central bore whereby said dart is maintained engaged in sealing relation in said shutoff receiving and seating surface at said upper end of sealing assembly by drilling fluids and pressure conducted through said upper central bore.

8. The multi-gage blowout preventer test tool according to claim 1, further comprising positioning means connected with said outer test tube assembly for positioning said second set of said longitudinally spaced pipe gage diameters of said outer test tube assembly within said blowout preventers when said outer test tube assembly is in said released condition.

9. A method for testing different size ram and annular subsea blowout preventers in one trip in a subsea wellhead, comprising the steps of:

providing a multi-gage blowout preventer test tool having an inner tube assembly, a lower connecting member at a lower end of said inner tube assembly for connecting said inner tube assembly to a wellhead sealing tool, an outer test tube assembly surrounding said inner tube assembly and having a plurality of longitudinally spaced pipe gage diameters formed on an exterior surface thereof corresponding in size to outside diameters of different drill pipe diameters, releasable and connectable coupling means at a lower end of said outer test tube assembly for selective connection to said lower connecting member, and an upper connecting member at an upper end of said outer test tube assembly for connecting said test tube assembly to a drill pipe string;

connecting said upper connecting member to a drill pipe string;

connecting said lower connecting member to said releasable and connectable coupling means;

connecting said lower connecting member to said wellhead sealing tool;

lowering said multi-gage blowout test tool and said wellhead sealing tool through said subsea blowout preventers to set said wellhead sealing tool in said subsea wellhead;

testing said blowout preventers against a first set of said longitudinally spaced pipe gage diameters with said outer test tube assembly positioned within said blowout preventers and said releasable and connectable coupling means in a connected condition;

uncoupling said releasable and connectable coupling means from said lower connecting member;

raising said outer test tube assembly to position a second set of said longitudinally spaced pipe gage diameters of said outer test tube assembly within said blowout preventers; and testing said blowout preventers against said second set of pipe gage diameters.

10. The method according to claim 9, including the step of conducting drilling fluids through said multi-gage blowout preventer test tool during said testing of said blowout preventers.

* * * * *